United States Patent [19]

Endo et al.

[11] 4,132,882

[45] Jan. 2, 1979

[54] PROCESS AND APPARATUS FOR FIXING TONER WITH HEAT AND A FIXING AGENT

[75] Inventors: Ichiro Endo, Yokohama; Toshiyuki Komatsu, Kawasaki; Yoshio Takasu, Tokyo, all of Japan

[73] Assignee: Canon Kabushiki Kaisha, Tokyo, Japan

[21] Appl. No.: 700,152

[22] Filed: Jun. 28, 1976

[30] Foreign Application Priority Data

Jul. 4, 1975 [JP] Japan ..... 50-82450
Jul. 8, 1975 [JP] Japan ..... 50-83859

[51] Int. Cl.[2] ..... H05B 1/00
[52] U.S. Cl. ..... 219/216; 118/60; 219/388

[58] Field of Search ..... 219/216, 388; 355/3 FU; 250/317-319; 427/22, 16; 118/60

[56] References Cited

U.S. PATENT DOCUMENTS 3,493,412 2/1970 Johnston et al. ..... 427/22
3,893,761 7/1975 Buchan ..... 355/3 R

*Primary Examiner*—C. L. Albritton
*Attorney, Agent, or Firm*—Fitzpatrick, Cella, Harper & Scinto

[57] ABSTRACT

Toner images are fixed by selectively elevating the temperature of the toner image portions and supplying a fixing agent to the toner image portions at the elevated temperature by utilizing the temperature difference between the toner image portions and the non-image portions.

23 Claims, 4 Drawing Figures

PROCESS AND APPARATUS FOR FIXING TONER WITH HEAT AND A FIXING AGENT

BACKGROUND OF THE INVENTION

1. Field of the Invention

The present invention relates to a process for fixing a toner image and a fixing agent composition therefor, and more particularly, to a process for fixing a toner image formed by electrophotography, electrostatic printing, magnetic printing or adherography, of fixing a toner image transferred to a transferring member, and a fixing agent composition therefor.

2. Description of the Prior Art

Heretofore, it has been known that toner images are produced by various image forming methods and, if desired, are transferred to a final image supporting member and fixed. The toners used here are, in general, finely divided powders composed of a mixture of a thermoplastic resin and a coloring matter, and the toners give toner images by a dry type or wet type developing method. The resulting toner image can be everlastingly fixed onto a supporting member by melting or dissolving the toner using heat, pressure or a solvent vapor.

Fixation by using a solvent vapor is disclosed in U.S. Pat. No. 2,776,907 and is more efficient than heat fixation, but the solvent vapor contaminates the air, that is, there is a problem from a hygienic point of view. Therefore, heat fixation is widely used for fixing toner images. Heat fixation should be effected at a temperature lower than the heat degradation temperature of the support such as paper, and for the purpose of completely fixing toners at a high fixing speed, toners of a low fusing temperature should be used. However, toners of a low fusing temperature tend to agglomerate during use and storage and cause blocking phenomenon.

High speed copiers have been recently used and there is employed a fixing method using heat rollers capable of giving a high efficiency of heat transfer, for example, as disclosed in U.S. Pat. Nos. 3,108,863; 3,612,820; 3,649,992; and 3,743,403. Toners used in said mixing methods should satisfy the conditions as to fusing temperature as mentioned above and furthermore, should be of a good releasability free from offset on a heat roller. A material capable of enhancing releasability of toners often causes blocking phenomenon. Therefore, it is difficult to select proper toner materials, and improved toners free from the above mentioned disadvantages are more expensive than conventional ones.

Fixation of toners by pressure is disclosed in, for example, U.S. Pat. No. 3,269,626 and can be effected with only a small amount of energy, and furthermore, an instant starting and high speed fixation can be effected. However, it is complicated to produce a pressure sensitive toner and a toner having a pressure sensitivity and the general characteristics required for toners are usually complicated in its composition and are expensive. Thus, pressure fixation is not yet so widely employed.

In view of the foregoing, toners satisfying chargeability, storage stability, durability, transferability as well as fixability are obtained with difficulty because materials satisfying all of these characteristics are hardly found and the process for preparing such toner is usually very complicated and the resulting toner becomes expensive.

Materials for improving fixability of toners usually have adverse effects on various characteristics required for toners other than fixability and therefore, have not been used. These situations hinder providing a high speed fixation with a reasonable toner. Further it has been proposed to provide preliminarily the whole surface of a support with a fixing agent, but this treatment soils the support and the support thus treated is not inscribable.

SUMMARY OF THE INVENTION

An object of the present invention is to provide a process for fixing a toner image free from the above mentioned various drawbacks.

Another object of the present invention is to provide a process for easily and completely fixing a toner image at a high speed regardless of the fixability of the toner itself.

A further object of the present invention is to provide a process for rapidly and completely fixing a toner image at a low temperature regardless of the fusing temperature of the toner itself.

Still another object of the present invention is to provide a process for fixing a toner image at a low temperature using a heat roller.

A still further object of the present invention is to provide a process for fixing a toner image by a pressure fixation with an inexpensive toner.

Still another object of the present invention is to provide a toner image fixing process which consumes only a small amount of a fixing agent.

A still further object of the present invention is to provide a fixing agent composition used for the above mentioned process for the fixation of a toner image.

According to the present invention, there is provided a process for fixing a toner image which comprises a step of selectively elevating the temperature of a toner image portion on a support, and a step of supplying a fixing agent to the toner image portion at the elevated temperature by utilizing the temperature difference between the toner image portion and the non-image portion simultaneously with or subsequently to the step of selectively elevating the temperature of the toner image portion.

According to another aspect of the present invention, there is provided a fixing agent composition which comprises, as a main component, an organic compound having a melting point or softening point of 20–200° C. or a mixture having an apparent melting point or softening point of 20–200° C.

DESCRIPTION OF THE PREFERRED EMBODIMENTS

According to the present invention, a fixing agent is not incorporated into the toner because the toner characteristics are adversely affected by the fixing agent, but a fixing agent is applied after the toner image has been formed. The fixing agent is selectively attached to the toner image portion. As the method for attaching the fixing agent to the toner image portions, the temperature difference between the toner image portion and the non-image portion is utilized. The temperature difference may be produced by a difference of heat absorption between the toner image portion and the non-image portion, and for example, the temperature of the toner image portion is selectively elevated. In this case, the elevated temperature at the image portions varies depending upon the type of fixing agent to some extent, but may be a temperature far lower than the fusing temperature of the toner.

The toner image to which the fixing agent is attached may be heated and/or pressed simultaneously with or subsequently to the above mentioned steps of selectively elevating the temperature of the toner image portion and supplying a fixing agent to the toner image portion.

In the present invention, the toner images may be formed on a support receiving a finally fixed image by any of the conventional processes such as electrophotographic processes, electrostatic printing processes, magnetic printing processes and the like. Further, the development may be effected by so-called dry or wet developing processes or other developing processes.

The temperature difference between the toner image portion and the non-image portion may be produced by supplying one or more of various energies such as light, heat, electricity, pressure and the like. In general, there is used radiation heat, Joule heat or high frequency induction heating. If the toner is of a large heat content, the toner image may be formed by using a preliminarily heated toner. It will be clear that the process for fixing a toner image according to the present invention can be conducted as long as there is formed a temperature difference between the toner image portion on the support and the non-image portion and the toner image has an elevated temperature. The method for producing a toner image having a temperature higher than the non-image portion is not restricted to any particular method.

Figure 1:
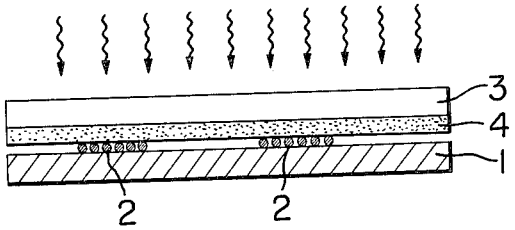
FIG. 1 and FIG. 2 show diagrammatically, an embodiment of a fixing process according to the present invention.
Figure 2:
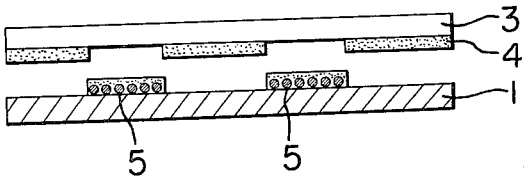

Now referring to FIG. 1, unfixed toner images 2 are formed on support 1, and fixing agent 4 coated on transparent sheet 3 which is transparent to radiation is placed on toner images 2. When the combined layers are irradiated by a radiation generated by a halogen lamp from the transparent sheet 3 side, the temperature of toner images 2 is elevated and the fixing agent contacting the toner is softened or melted, and as shown in FIG. 2, when transparent sheet 3 is peeled off, the fixing agent thus attached to toner images 2 remains on the toner image 2, and fixed toner images 5 are formed. Thus the toner images are fixed to the support by the fused and then solidified fixing agent. Depending upon the type of fixing agent, a heat chamber fixation, heat roller fixation or pressure fixation may be additionally applied thereto.

In this way, toner images can be easily and completely fixed to a support at a high speed with a fixing agent. When the support is a transparent sheet, it is possible to apply a radiation from the support side.

Figure 3:
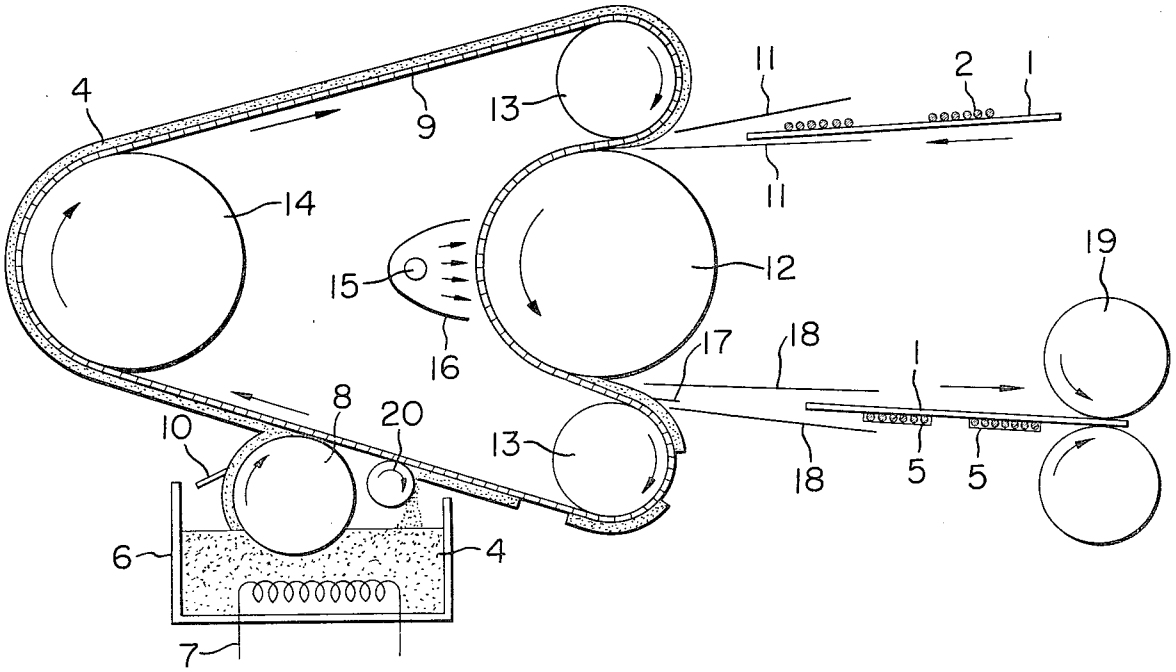

Referring to FIG. 3, fixing agent 4 is heated and melted in vessel 6 by heater 7, and coated on a heat resistant and transparent endless belt 9 such as a polyethylene terephthalate film, Teflon film, silicone rubber film and the like by coating roller 8. The thickness of the fixing agent to be coated is controlled by blade 10. The optimum thickness of the fixing agent varies depending upon the fixing agent used. It is usually 0.5–100 microns, preferably 10–50 microns. The surface of the transparent sheet may be treated with a releasing agent to improve releasability of the fixing agent.

A sheet having unfixed toner images 2 on support 1 is sent along guide 11 and passes between roller 12 and transparent sheet 9 having a fixing agent coating thereon. Fixing agent 4 is coated on transparent sheet 9, transferred by rollers 13 and 14, placed on unfixed toner images at roller 12 of the same peripheral speed, and then sent to a radiation irradiating step. The radiation heat source is made of halogen lamp 15 and reflecting mirror 16. After being radiation with a radiation, the image sheet is separated from the transparent sheet by separating pawl 17 and taken out along guide 18. Thus, fixed toner image 5 is produced, and if desired, is passed through a heat (or pressure) roller fixing device 19.

The fixing agent remaining on the transparent sheet and not fixed to the toner images is scraped away with a cleaning roller 20 and used again.

Figure 4:
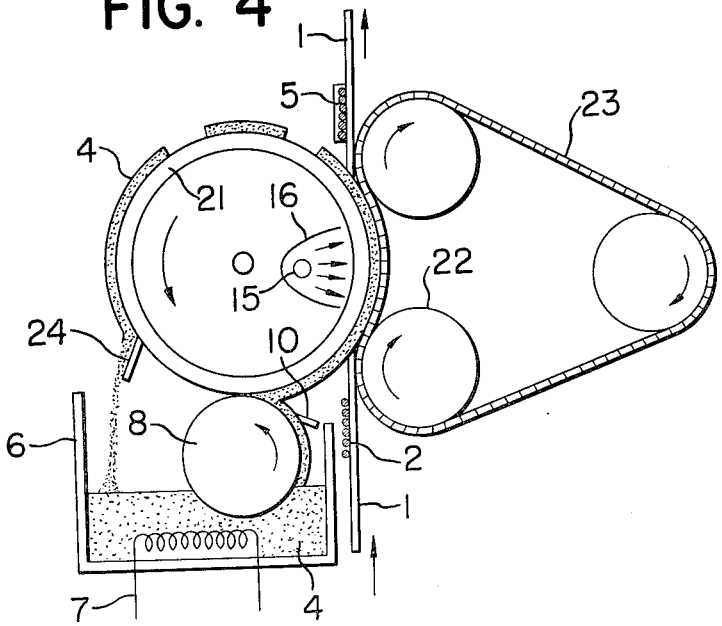
FIG. 3 and FIG. 4 show diagrammatically, embodiments of apparatus for continuously carrying out the fixing process according to the present invention.

Referring to FIG. 4, a fixing agent is carried by a glass cylinder 21, and in a way similar to FIG. 3, fixing agent 4 is heated and melted in vessel 6 by heater 7, and coated on the heat resistant glass cylinder 21 by a coating roller 8. The amount of fixing agent is controllable by blade 10. Support 1 having unfixed toner image 2 is passed between roller 22, pressing belt 23 and glass cylinder 21 coated with a fixing agent, and subjected to a radiation heat, and then, fixed toner image 5 is obtained. The remaining fixing agent is scraped by cleaning member 24 and used again.

As to the fixing agent composition used in the present invention, in view of the above mentioned explanation about the fixing method according to the present invention, those skilled in the art can understand what characteristics the fixing agent materials should have, and select optimum fixing agents.

Desirable characteristics for the fixing agent are as follows. The fixing agent has a melting point or softening point of not higher than the melting point of the toner, usually 20–200° C., preferably 30–170° C., more preferably 40–130° C., and the fixing agent can attach to a toner image portion of an elevated temperature in a softened or melted form, but does not attach to the non-image portion, and further can fix the toner image to the support by solidifying fixation or melting fixation. It is preferable that the melting point or softening point is sharp as far as possible and the fixing agent has a lubricating property capable of preventing the toner image from adhering to the roller or others.

Examples of the fixing agent are given below and they may be used in combination.

Organic compounds having a softening point or melting point of 20–200° C., preferred 30–170° C., more preferably 40–130° C., or a mixture of organic compounds having such as apparent melting point or softening point.

As the fixing agent composition used for the process for fixing toner images according to the present invention, the above mentioned materials may be used alone or in combination. Even if the material is liquid or of a high melting point, it can be used by mixing with other materials accordingly. For the purpose of controlling melting point and viscosity when melted, it may be mixed with other polymers. Further, for the purpose of lowering the self cohesion when melted, silica colloid may be dispersed in the fixing agent material or there may be added a lubricant material, for example, silicone oil such as dimethyl silicone, methyl chlorinated phenyl silicone, methyl phenyl silicone, methyl hydrogen silicone and the like. Further, a surface-active agent may be added. In addition, the fixation of a toner becomes better when a small amount of a solvent or plasticizer for the toner resin is added to the fixing agent.

For example, as waxes, there may be mentioned petroleum waxes such as paraffin wax, micro wax, polyolefin wax (for example, polyethylene wax and polypropylene wax, both of which are of low molecular weight) and the like, and natural wax like material such as carnauba wax, montan wax, microcrystalline wax, beeswax, rosin and the like.

As fatty acids, there may be mentioned lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacasanoic acid, montanic acid, melissic acid, lacceric acid and the like.

As metal salts of fatty acids, there may be mentioned lead caproate, lead enanthate, lead caprylate, lead pelargonate, lead caprate, lead laurate, lead myristate, lead palmitate, lead stearate, lead tridecylate, aluminum stearate, beryllium stearate, zinc stearate, magnesium stearate and the like.

As amides of fatty acids, there may be mentioned acetic amide, propionic amide, butyric amide, valeric amide, capronic amide, enanthic amide, capric amide, caprylic amide, undecylic amide, lauric amide, myristic amide, palmitic amide, stearic amide, behenic amide, oleic amide, capric methylamide, lauric methylamide, myristic methylamide, palmitic methylamide, stearic methylamide, lauric dodecylamide, myristic dodecylamide, palmitic dodecylamide, stearic dodecylamide and the like.

As anilides of fatty acids, there may be mentioned valeric anilide, caproic anilide, caprylic anilide, pelargonic anilide, capric anilide, undecylic anilide, lauric anilide, myristic anilide, palmitic anilide, stearic anilide, behenic anilide and the like.

As esters of fatty acids, there may be mentioned methyl arachate, methyl behenate, methyl cerotate, methyl melissinate, ethyl behenate, ethyl lignocerate, ethyl montanate, ethyl laccerate, butyl oleate, methyl acetyl-ricinoleate, phenyl arachate, phenyl palmitate, glycol myristate, glycol palmitate, glycol stearate, glycerol laurate, glycerol myristate, glycerol palmitate, glycerol stearate and the like.

As phthalic acid esters, there may be mentioned diethyl phthalate, dibutyl phthalate, dioctyl phthalate, ditridecyl phthalate, dicyclohexyl phthalate, dimethyl isophthalate, diphenyl phthalate, dioctyl tetrahydrophthalate and the like.

As phosphoric acid esters, there may be mentioned trioctyl phosphate, triphenyl phosphate and the like.

As high polymers of a low molecular weight, there may be mentioned, for example, polyacrylic acid ester, a styrenebutadiene copolymer, polyvinyl butyral and polyamide which have a low molecular weight.

As other examples, there may be mentioned diphenic acid, ethylene glycol, diethylene glycol benzoate, epoxy linseed oil, butyl epoxystearate, ethylenephthalylbutyl glycolate, a polyester series plasticizer, a nitrile series synthetic rubber, a dibasic acid ester of a straight chain, an oligomer and the like.

As preferable examples of the solvent and plasticizer, there may be mentioned various esters such as phthalic acid ester, aromatic dibasic acid ester, glycol ester, fatty acid ester, phosphoric acid ester and the like. As concrete examples thereof, there may be mentioned diethyl phthalate, dibutyl phthalate, dioctyl phthalate, ditridecyl phthalate, dicyclohexyl phthalate, diisodecyl succinate, dioctyl adipate, dioctyl tetrahydrophthalate, diethylene glycol dibenzoate, butyl oleate, methyl acetylricinoleate, trioctyl phosphate, triphenyl phosphate, epoxy linseed oil, butyl epoxystearate, ethylenephthalylbutyl glycolate and the like.

The types of toner to be fixed according to the present invention is not restricted to any particular one. For example, powder images composed of magnetic powders not containing a thermoplastic resin such as iron powders, or inorganic or organic pigments can be fixed by the present invention. Further, conventional toners can be fixed at a high speed at a lower temperature. In addition, some toners which have not been used because of lack in fixability also can be used according to the present invention.

When the process for fixing a toner image according to the present invention is employed, the toner composition may be selected without taking fixability into consideration. Therefore, binder resins, dyes, pigments and the like as components of a toner composition can be freely selected taking into consideration only chargeability, use stability, durability, storage stability and transferability.

As the binder resin, there may be mentioned, for example, synthetic resins such as polystyrene, polyvinyl chloride, phenolic resin, epoxy resin, polyester resin, styrenebutadiene copolymer, xylene resin, butyral resin, polyamide, acrylic resin, methacrylic resin, polyethylene, polypropylene and the like and natural resins such as rosin, alkyd resin and the like.

If necessary, an infrared ray absorbing agent may be added to a toner when it is a color toner or a light color toner though such addition of an infrared ray absorbing agent is not necessary when a black dye or pigment toner is used.

The support to which toner images are fixed may be a conventional one such as paper, resin film and the like. If desired, the surface of the support may be treated so as to prevent the fixing agent from adhering to the non-image portions.

The process for fixing according to the present invention is better than a conventional process as is clear from the following calculated values.

Energy W necessary for fixation is represented by the following formula.

$$W = \frac{C \cdot m \cdot S}{\eta \cdot t} \cdot \Delta T$$

where C is the specific heat of a toner or a fixing agent and is usually about 0.5 cal./°C.g.; m is the weight amount of a toner per unit area and is usually about 0.5 $\times 10^{-3}$ g./cm.$^2$ at an image density of 1.0; S is the heat radiation area and 30 cm.$^2$ is selected here (longitudinal length 30 cm. and width 1 cm.); $\rho$ is the product of the heat generating efficiency of the radiation heat source and the heat absorption efficiency of the toner and is deemed as 40% here; t is the radiation time and is given as the reciprocal of fixing speed, for example, when the fixing speed is 50 cm./sec., the radiation time is 0.02 sec.; and $\Delta T$ is the temperature necessary for fixation.

Assuming that a fusing temperature of a conventional toner is $\Delta T = 170°$ C., the energy necessary for fusing the toner is about 655 watt/sec. On the contrary, when the temperature necessary for melting the fixing agent is about $\Delta T = 70°$ C., the energy W necessary for fixation is 274 watt/sec.

The above results show that the fixing process according to the present invention is of high efficiency.

The invention will be understood more readily by reference to the following examples. However, these examples are intended to illustrate the invention and are not to be construed to limit the scope of the invention.

EXAMPLE 1

95 parts by weight of polystyrene (Piccolastics D-125, a trade name for a product of Esso Chemicals) and 5 parts by weight of carbon black were sufficiently melted, kneaded and finely pulverized to obtain a toner. The toner was mixed with iron powder to prepare a developer.

An unfixed toner image was formed by use of the prepared developer on an ordinary paper by an electrophotographic process disclosed in Japanese Patent Publication Nos. 23910/1967, 24748/1968 and 27735/1972.

A fixing agent, an organic compound listed in Table-1, was coated on a transparent polyethylene terephthalate film having a thickness of 70 microns so as to be 20 microns in thickness to prepare a fixing agent sheet.

The above-mentioned toner image surface and the fixing agent on the sheet were brought into contact with each other and, from the fixing agent sheet side, irradiated with a radiation heat source in which a light of 1.5 KW halogen lamp was condensed by a reflecting mirror. The irradiation energy was about 40 watt/cm.$^2$ and irradiation time was 0.05 sec.

After irradiation of the radiation heat, the fixing agent sheet was peeled off from the image surface. It was found that the fixing agent adhered to the toner image portion and the toner image was fixed.

In addition, when the toner image given the fixing agent was pressed for 0.05 second between heat rollers heated at 150° C. for the purpose of improving the fixation, a perfectly fixed image was obtained.

The same test as mentioned above was carried out with various fixing agents, or without a fixing agent, the results of which are shown in Table-1.

Table 1

| Fixing agent | Fixation of image after irradiation of radiation | Fixation of image after press by heat rollers |
|---|---|---|
| None | X | X |
| Paraffine wax | Δ | ○ |
| Polyethylene wax | ○ | ◎ |
| Polypropylene wax | ○ | ◎ |
| Carnauba wax | ○ | ○ |
| Stearic acid | Δ | ○ |
| Behenic acid | Δ | ○ |
| Aluminum stearate | ○ | ○ |
| Lead stearate | ○ | ○ |
| Caprylic methylamide | Δ | ○ |
| Lauric dodecylamide | ○ | ○ |
| Lauric amide | Δ | ○ |
| Stearic anilide | ○ | ○ |
| Caproic anilide | ○ | ○ |
| Methyl behenate | ○ | ○ |
| Glycol myristate | ○ | ○ |
| Glycerol laurate | Δ | ○ |
| Polystearyl acrylate | ○ | ◎ |
| Polyethylene plus Paraffine wax (1 : 4 ratio by weight) | ○ | ○ |

◎ Perfectly fixed,
○ Sufficiently fixed for practical use,
Δ fixed, but when the image is strongly rubbed, a part of the image becomes blur,
X Not fixed at all

EXAMPLE 2

The same procedure as in Example 1 was repeated except that 50% by weight of one of diethyl phthalate, dioctyl phthalate and dicyclohexyl phthalate was incorporated into the paraffine wax. The toner image was extremely preferably fixed.

In Example 1, where paraffine wax alone was used as a fixing agent and only irradiation of radiation was conducted, without pressing the toner image surface by heat rollers, the fixation of the toner image was not perfect to some extent. However, when a solvent or plasticizer for the toner resin was incorporated into the fixing agent in a small amount as in this example, the toner image was sufficiently fixed only by irradiation of radiation heat, that is, without pressing the image by the heat rollers. After irradiation of radiation heat, the toner image given the fixing agent was coated to pass between a Teflon-applied roller and a metal roller for pressure fixing (a pressure of 20 Kg./cm.$^2$) at a speed of 30 cm./sec. so that a perfectly fixed image was obtained.

On the other hand, after the toner image not given a fixing agent was caused to pass between pressure fixing rollers, it seems to be fixed. However, the toner image was eliminated or came off when it was strongly rubbed or the image sheet was folded.

EXAMPLE 3

A fixing agent composed of one part by weight of silicone oil (TSF 410, a trade name for a product of Toshiba Silicone K.K.) and 10 parts by weight of paraffine wax (m.p. 60° C.) was given to the unfixed toner image obtained in Example 1 at a speed of 50 cm./sec. by using an apparatus as shown in FIG. 3 (provided with a 1 KW halogen lamp). As the result, the toner image was substantially fixed. This image was further caused to pass between silicone rubber rollers heated at 150° C. at a speed of 50 cm./sec. to obtain a good image which was fixed perfectly in the whole surface.

On the other hand, where a fixing agent was not given to the toner image, the image was not fixed even when it was caused to pass between the rollers at 150° C., and offset phenomenon of the toner to the roller surface was often observed when the image was caused to pass between the rollers at 200° C. although it was fixed at 200° C. However, when the above-mentioned fixing agent was given to the toner image, such an offset phenomenon was not observed at all. In addition, when colloidal silica powder was used in place of silicone oil in the same amount in preparing the fixing agent, a good result was similarly obtained.

EXAMPLE 4

In the procedure of Example 1, the following resins were used as a binder resin for the toner in place of polystyrene to prepare toners.

(1) Epoxy resin (Epikote 1007, a trade name for a product of Shell Chemical Co.), (2) Styrene-butadiene resin (Nippol 2007J, a trade name for a product of Nippon Zeon, Co., Ltd.), (3) Phenolic resin (Super Beckacite 3011, a trade name for a product of Japan Reichhold Chemicals, Inc.), (4) Xylene resin (Nikanol HP-70, a trade name for a product of Mitsubishi Gas Chemical Co., Inc.), and (5) Butyral resin (S-Lec BM-2, a trade name for a product of Sekisui Kagaku K.K.).

The prepared toners were used to repeat the same procedure as that in Example 1 so that a good fixed image was obtained in each case.

EXAMPLE 5

15 parts by weight of a phenolic resin (Beckacite 1100, a trade name for a product of Japan Reichhold Chemicals, Inc.) and 10 parts by weight of natural cyclized rubber were dissolved in 65 parts by weight of xylene, and then 10 parts by weight of carbon black was mixed therewith and dispersed in a ball mill for one hour. The resulting mixture was diluted with a 20-fold excess of Isopar H (a trade name for a product of Esso Chemicals) in relation to the amount of the mixture and stirred, and further dispersed for two hours in a ball mill. 10 m mol/liter of aerosol OT was added to the dispersion to prepare a liquid developer.

An unfixed transferred toner image was formed by means of the liquid developer thus prepared on an ordinary paper in accordance with the electrophotographic process disclosed in Japanese Patent Publication No. 24077/1970. The unfixed image was given a fixing agent composed of polypropylene (m.p. 140° C.) and paraffine wax (m.p. 60° C.) in a ratio by weight of ¼ in the same manner as that in Example 1 so that a good fixed image was obtained.

In addition, when a liquid developer of the same composition as that of the foregoing liquid developer except that the natural cyclized rubber was not used was prepared and it was given to the unfixed image in the same manner as mentioned above, a good result was obtained similarly.

On the other hand, when the fixing agent was not given to the unfixed image which was developed with the above liquid developer, the image fixation remained poor even after the Isopar H was dried.

EXAMPLE 6

An electrostatic latent image was formed on a zinc oxide paper and it was visualized with iron powder of 500–1000 mesh adhered to a magnet. The iron powder image was given a fixing agent composed of polyethylene (m.p. 120° C.) and paraffine wax (m.p. 60° C.) in a ratio by weight of one-half in the same manner as in Example 1 so that the image was advantageously fixed on the zinc oxide paper. When the image was caused to pass between the pressure fixing rollers used in Example 2, a quite perfect fixed image was obtained.

What is claimed is:

1. A process for fixing a toner image comprising the steps of: (a) providing a receiving surface having a toner image portion and a non-toner image portion; (b) contacting said toner image portion with a supported layer of fixing agent for said toner image; (c) providing sufficient heat to said toner image portion after step (a) to cause the fixing agent to selectively adhere to said toner image portion; and (b) separating said receiving surface from said supported layer of fixing agent after the fixing agent selectively adheres to the toner image portion.

2. A process according to claim 1, wherein the heat provided to said toner image portion includes radiant heat.

3. A process according to claim 1, wherein the heat provided to said toner image portion includes Joule heat.

4. A process according to claim 1, wherein high frequency induction heating is used to provide at least some of the heat provided to said toner image portion.

5. A process according to claim 1, wherein the fixing agent is a mixture having an apparent melting point or softening point between 20 and 200° C.

6. A process according to claim 1, wherein contacting step (b) precedes heating step (c).

7. A process according to claim 1, wherein heating step (c) precedes contacting step (b).

8. A process according to claim 1, wherein contacting step (b) and heating step (c) are carried out simultaneously.

9. A process according to claim 1, further comprising the step of applying additional heating after the fixing agent selectively adheres to the toner image portion.

10. A process according to claim 1, further comprising the step of applying pressure to the receiving surface after the fixing agent selectively adheres to the toner image portion.

11. A process according to claim 1 in which the fixing agent is an organic compound having a melting point or softening point of 20–200° C.

12. A process according to claim 1 in which the thickness of the fixing agent layer is 0.5–100 microns.

13. A process according to claim 1 in which the thickness of the fixing agent layer is 0.5–100 microns.

14. The process of claim 11 wherein said organic compound is a member selected from the group consisting of waxes, fatty acids, fatty acid metal salts, fatty acid amides, fatty acid anilides, fatty acid esters, phthalic acid esters, phosphoric acid esters, low molecular weight polymers, diphenic acid, ethylene glycol, diethylene glycol benzoate, epoxy linseed oil, butyl epoxystearate, ethylenephthalylbutyl glycolate, polyester series plasticizers, nitrile series synthetic rubber, straight chain diabasic acid esters and oligomers.

15. The process of claim 14 wherein said fixing agent further contains a silica colloid.

16. The process of claim 14 wherein said fixing agent further contains a silicone oil.

17. The process of claim 14 wherein said fixing agent further contains a surface active agent.

18. The process of claim 14 wherein said toner comprises a coloring matter and a resin, and wherein said fixing agent further contains a solvent or plasticizer for said toner resin.

19. An apparatus for fixing a toner image on a receiving sheet with a fixing agent comprising:

means for coating a support with a layer of fixing agent;

means for contacting said supported layer of fixing agent with the toner image on said receiving sheet;

means for selectively heating said toner image to cause said fixing agent to selectively adhere to said toner image; and means for separating said receiving sheet from said supported layer of fixing agent after said fixing agent selectively adheres to said toner image.

20. An apparatus according to claim 19, wherein said heating means heats said toner image after said toner image contacts said fixing agent.

21. The apparatus of claim 19 wherein said selective heating means heats said toner image simultaneously with the contacting of said toner image with said fixing agent.

22. The apparatus of claim 19 wherein said selective heating means heats said toner image prior to contact of said toner image with said fixing agent.

23. The apparatus of claim 19 wherein said contacting means comprises the support upon which the layer of fixing agent is coated on a first side thereof and means to contact said toner image with said side bearing said fixing agent, wherein said support is transparent and wherein said selective heating means includes radiation means for irradiating said toner image through said transparent support while in contact with said fixing agent.

* * * * *

UNITED STATES PATENT AND TRADEMARK OFFICE

CERTIFICATE OF CORRECTION

PATENT NO. : 4,132,882

DATED : January 2, 1979

INVENTOR(S) : Ichiro Endo, et al.

It is certified that error appears in the above-identified patent and that said Letters Patent are hereby corrected as shown below:

Column 3, line 47, "image" should read --images--.

Column 4, line 7, "radiation" should read --irradiated--.

Column 4, line 19, "controllable" should read --controlled--.

Column 4, line 48, "preferred" should read --preferably--.

Column 4, line 50, "as" should read --an--.

Column 6, line 4, "types" should read --type--.

Column 6, line 50, "C.g" should read --C˙g--.

Column 6, line 54, "ρ" should read --η--.

Column 9, line 53, "(b)" should read --(d)--.

Column 10, line 28, "diabasic" should read --dibasic--.

Signed and Sealed this

*Third* Day of *July 1979*

[SEAL]

*Attest:*

*Attesting Officer*

LUTRELLE F. PARKER

*Acting Commissioner of Patents and Trademarks*